US005190474A

United States Patent [19]

Ginet

[11] Patent Number: 5,190,474

[45] Date of Patent: Mar. 2, 1993

[54] COAXIAL CONNECTOR FOR CONNECTING A COAXIAL CABLE TO A PRINTED ELECTRONIC-CIRCUIT BOARD

[75] Inventor: Guy A. Ginet, Voiron, France

[73] Assignee: Radiall, Rosny-sous-Bois, France

[21] Appl. No.: 898,460

[22] Filed: Jun. 15, 1992

[30] Foreign Application Priority Data

Jun. 17, 1991 [FR] France ..... 91 07370

[51] Int. Cl.[5] ..... H01R 13/66

[52] U.S. Cl. ..... 439/581

[58] Field of Search ..... 439/63, 578–585

[56] References Cited

U.S. PATENT DOCUMENTS

| | | | |
|---|---|---|---|
| 3,293,592 | 12/1966 | Blonder . | |
| 4,138,179 | 2/1979 | Miller et al. | 439/63 |
| 4,360,244 | 11/1982 | Forney, Jr. et al. | 439/581 |
| 4,412,717 | 11/1983 | Monroe | 439/581 |
| 4,743,205 | 5/1988 | Mitani et al. . | |
| 5,011,415 | 4/1991 | Suzuki et al. . | |

FOREIGN PATENT DOCUMENTS

| | | |
|---|---|---|
| 0041023 | 12/1981 | European Pat. Off. . |
| 419938A2 | 2/1991 | European Pat. Off. . |

*Primary Examiner*—Joseph H. McGlynn

*Attorney, Agent, or Firm*—Schweitzer Cornman & Gross

[57] ABSTRACT

The invention relates to a coaxial connector for connecting a coaxial cable to a printed electronic-circuit board. The connector element intended to be attached to the printed board is arranged as a cylindrical socket (1) comprising an external bush (3) provided integrally at its rear portion with means (5) for attaching it to a printed board, and a central contact (9) provided integrally at its rear portion with means (12) for attaching it to said printed board; the connector element intended to be fixed to the coaxial cable is arranged as a plug (2) comprising a tubular portion (16) for connection to the end of a coaxial cable and a tubular coupling portion (15) comprising a cylindrical external bush (22), and a central contact (26) comprising at its rear portion connection means (27) for the central conductor (17) of the coaxial cable, said central contacts of the two connector elements comprising interacting means (14, 30) for locking by snap-fastening.

12 Claims, 3 Drawing Sheets

COAXIAL CONNECTOR FOR CONNECTING A COAXIAL CABLE TO A PRINTED ELECTRONIC-CIRCUIT BOARD

BACKGROUND OF THE INVENTION

The present invention relates to a coaxial connector for connecting a coaxial cable to a printed electronic-circuit board.

The installation of components on printed electronic-circuit boards has for a long time been carried out with the aid of pointed elements provided on the components and which are inserted into plated-through holes in the board.

The attachment is carried out by means of a wave-soldering operation which makes it possible to attach all the components to the board at the same time.

More recently, it has been proposed to mount components on printed electronic-circuit boards using a technique called "surface mount" technique.

In this case, holes passing through the board are not provided, except where necessary for establishing electrical connections between various layers of circuits, which layers are provided on the board, and the components are fitted at their rear portion with flat lugs which are soldered onto pads provided at the surface of the board.

This technique enables the boards to be miniaturized and the operations for mounting the components on the boards to be automated.

Efforts have therefore naturally been made to produce all sorts of miniaturized components, and especially electrical connectors, which are capable of being installed and attached automatically to printed boards, especially using surface-mount means.

It has emerged that problems arise for the electrical connectors intended to connect a cable to the board, especially because the connector element mounted on the board has to be subjected to quite large mechanical stresses during coupling and uncoupling operations, most often performed manually, with the corresponding connector attached to the cable.

In the case of surface mounting, the coupling and uncoupling forces are transmitted to a great extent to the soldered joints and the pads of the board. In order to avoid breaking the connection of the connector element attached to the board, mechanical means for attachment to the board, especially of the nut and screw type, are most often added to this connector element. This prevents miniaturization of the connector to as high a degree as would be desired, and introduces an additional mounting step, such that the connector cannot be attached to the board during the automatic mounting and attachment of the other components.

Now, in modern equipment, it is important to have connectors, such as coaxial connectors, as miniaturized as possible, which are capable of being economically manufactured in volume and capable of being installed and attached completely automatically on printed boards.

By way of application, portable mobile radio-telephony equipment may be cited such as that of the new European generation GSM (Groupe Spécial Mobile), which is intended to operate at frequencies of 900 MHz, and for which it is important to produce microminiaturized coaxial connectors in order to provide the connection of coaxial cables to the printed electronic-circuit boards with which the equipment is fitted.

SUMMARY OF THE PRESENT INVENTION

The present invention aims to produce a coaxial connector for connecting a coaxial cable to a printed electronic-circuit board, which connector lends itself to very small-scale miniaturization whilst being able to be produced with few elements using simple manufacturing techniques, the connector according to the invention furthermore lending itself to automatic installation and attachment to the board at the same time as the other components because it does not require additional mechanical attachment means.

The coaxial connector according to the invention comprises two connector elements each comprising a central contact, respectively a male and female contact, an external ground contact and an insulation between the central contact and the ground contact, said connector elements comprising means for connecting them electrically and attaching them, respectively, to the end of a coaxial cable and to a printed board, wherein the connector element intended to be attached to the printed board is arranged as a cylindrical socket comprising an external bush which forms a ground contact, is radially elastic over a portion at least of its height and is provided integrally at its rear portion with means for attaching it to a printed board, and a central contact disposed in a central hole of a tubular insulation which is retained in said external bush and is provided, also integrally, at its rear portion, with means for attaching it to said printed board, and wherein the connector element intended to be attached to the coaxial cable is arranged as a plug comprising a tubular portion, for connection to the end of a coaxial cable, and a tubular coupling portion comprising a cylindrical external bush forming a ground contact, capable of engaging around the external bush of the connector element arranged as a socket, and a central contact which comprises at its rear portion connection means for the central conductor of the coaxial cable and which is immobilized in a tubular insulation retained in said external bush, said central contacts of the two connector elements comprising interacting means for locking by snap-fastening.

The connector element, intended to be attached to the printed board and arranged as a cylindrical socket, preferably comprises an elastic female central contact, and the other connector element, arranged as a plug and intended to be attached to the coaxial cable, comprises a pin-shaped male contact, the interacting means for locking said central contacts being constituted by an internal flange of the female contact capable of engaging elastically in a retention groove, provided on the periphery of the male contact, during the axial engagement of the male contact in the female contact.

In a particular embodiment, the female contact is produced in the form of a part, of substantially U-shaped cross section, retained by its rear portion in the central hole of the tubular insulation in which said part is mounted, and whose two elastic branches are slightly inclined one towards the other in the direction of their free end and each comprise an end portion folded over inwards in the direction of the other branch. The folded-over end portions of the two branches constitute the internal female-contact flange capable of engaging in the peripheral retention groove of the corresponding male contact.

For its connection and its attachment to the printed board, the female contact, in this embodiment, advantageously comprises, at its rear portion, a lug made as a single piece with the web connecting the two elastic branches, said lug being folded over at 90° outwards in relation to the axis of the connector element in which the female contact is mounted.

The external bush forming a ground contact of the connector element arranged as a socket and intended to be attached to the printed board advantageously comprises, over a portion of its height, at least one cut-out elastic tab projecting radially outwards from said bush in the disassembled state of the connector.

The elastic tab or tabs are compressed radially during the installation of the external bush forming a ground contact of the complementary connector element, which ensures an excellent electrical contact between the ground contacts of the two connector elements.

The external bush forming a ground contact of the connector element arranged as a socket advantageously comprises for its attachment and for its connection to the printed board a plurality of lugs folded over outwards in relation to the external bush in the same plane at 90° in relation to the axis of said bush.

Thus, the connector element arranged as a socket and comprising the various abovementioned lugs extending respectively the central contact and the ground contact may be surface attached to a printed electroniccircuit board.

For this purpose, some solder cream is conventionally deposited, using a silk screening process, on the pads provided on the board, the connector element arranged as a socket and the other components to be attached are laid down on the board and the solder cream is remelted using infrared or vapor-phase heating.

For error-free positioning of the connector element arranged as a socket, the lugs to be soldered, produced as a single piece with the external bush forming a ground contact, are preferably different from the lug extending the central elastic contact. Thus, for example, the lug of the central contact may have end chamfers.

The connector element arranged as a socket according to the invention thus advantageously consists of only three parts which can be manufactured using simple techniques. According to the invention, a microminiature connector element, that is to say in practice one which can have a height of the order of 2 mm, may be produced under cost-effective conditions.

In fact, the connector arranged as a socket comprises, as indicated hereinabove, an external bush which may be produced economically by cutting out and rolling a metal sheet made for example from a copper alloy, an insulation of simple shape which may be produced by molding, and a central contact which may be produced by cutting out and bending over a metal sheet made from a copper alloy.

The other connector element arranged as a plug and intended to be mounted at the end of a coaxial cable is preferably elbow shaped and its tubular portion for connecting to the end of the coaxial cable is disposed at right angles in relation to the tubular coupling portion and preferably produced integrally with it.

The rear end of the external bush of the coupling portion is fitted with a closing-off element installed after carrying out the connection to the coaxial cable, the closing-off element being either a separate cover or a folded-down portion of the wall of the external bush.

The connector element arranged as a plug may, in the same way as for the other connector element, be produced using cost-effective procedures.

Thus, the connector element arranged as a plug may consist of only three parts, namely a body comprising the external bush of the coupling portion and the tubular portion for coupling to the cable, it being possible for this body to be produced by molding, especially from a zinc/aluminum alloy, a central contact produced by machining and an insulation produced by molding.

In the case where it is not a wall element which is used for closing off the rear end of the external bush, the connector element arranged as a plug comprises a cover as a fourth part, it being possible for the cover also to be produced simply and cost-effectively.

Other advantages and characteristics of the invention will emerge on reading the following description of an entirely non-limiting embodiment by referring to the attached drawing in which:

DETAILED DESCRIPTION OF THE INVENTION

Figure 1:
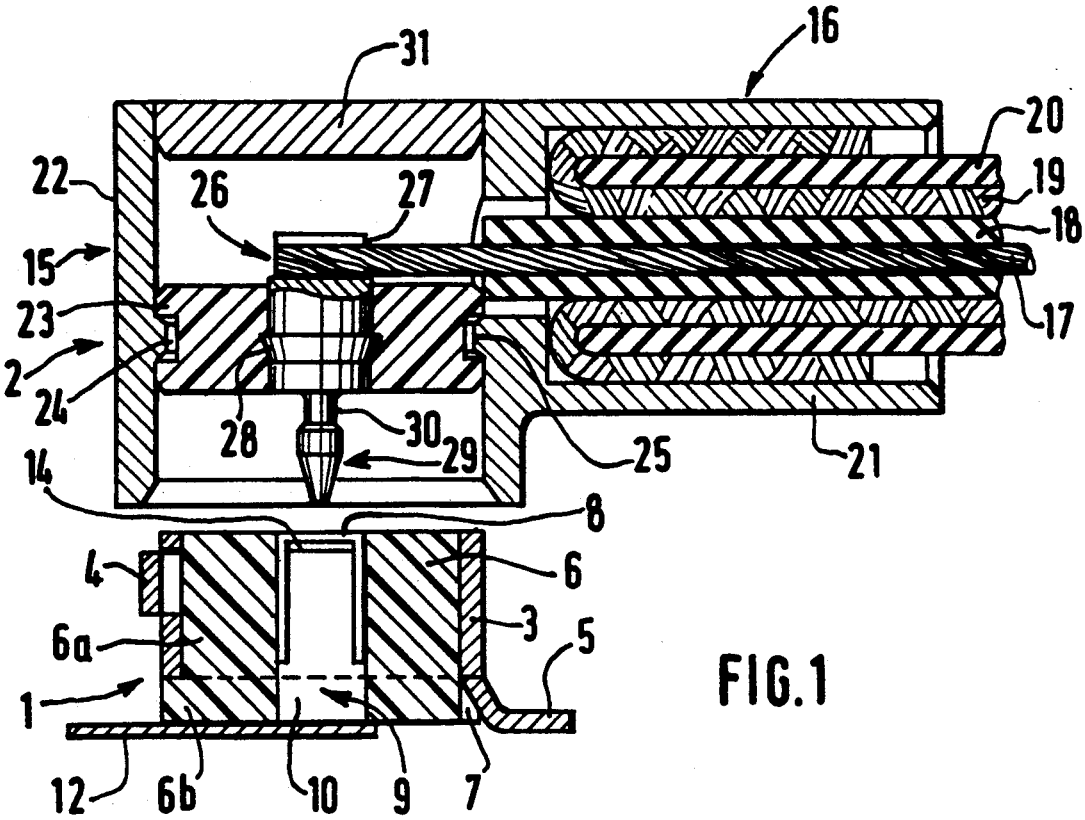
FIG. 1 is a sectional view of the two elements constituting a coaxial connector according to the invention before they are coupled.
Figure 2:
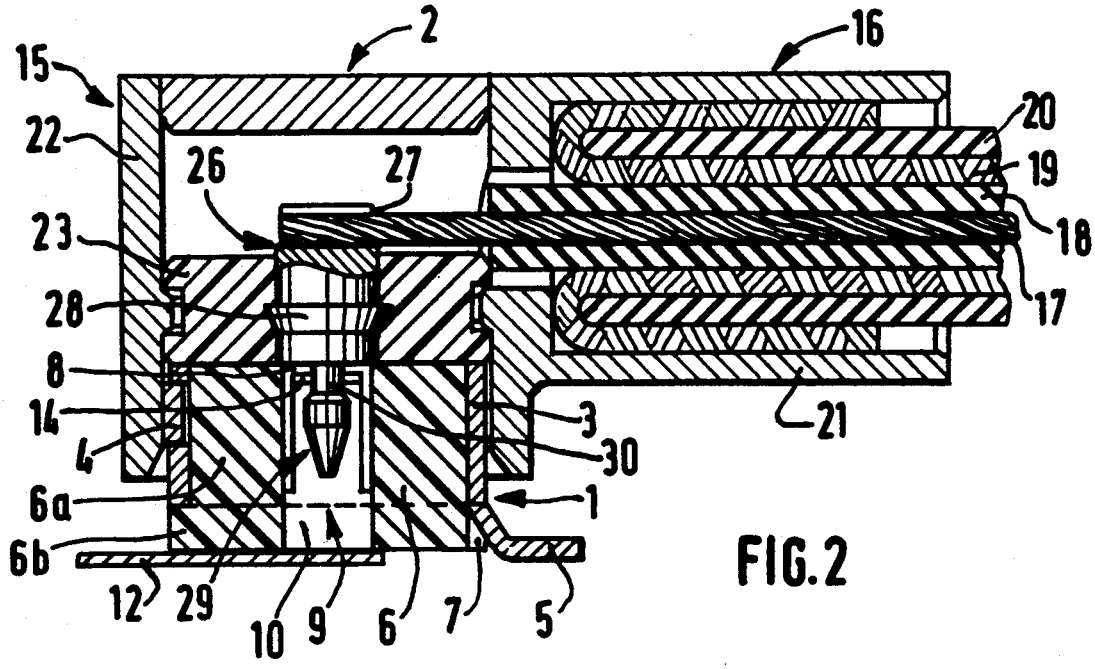
FIG. 2 is a view, similar to FIG. 1, of the two connector elements in the coupled position.

The connector according to the invention comprises a connector element arranged as a socket, designated overall by 1, intended to be attached at its rear portion to a printed electronic-circuit board (not shown), and a connector element, designated overall by 2 and arranged as a plug attached to the end of a coaxial cable, as illustrated in FIGS. 1 and 2.

First of all the socket 1 will now be described by referring more particularly to FIGS. 3 to 8.

The socket 1 comprises a cylindrical metallic bush 3 in which two elastic tabs 4, extending over a portion of the height of the bush and projecting radially from its periphery, are cut out.

At its rear portion, the bush 3 is extended by three lugs 5 bent over in the same plane at 90° outwards in relation to the socket 3.

A cylindrical tubular insulation 6, comprising a front cylindrical segment **6*a* tight-fittingly mounted in the bush 3, and a rear segment 6*b* of larger diameter comprising three axial recesses 7 for the passage of the lugs 5, are housed inside the cylindrical bush 3**.

Figure 3:
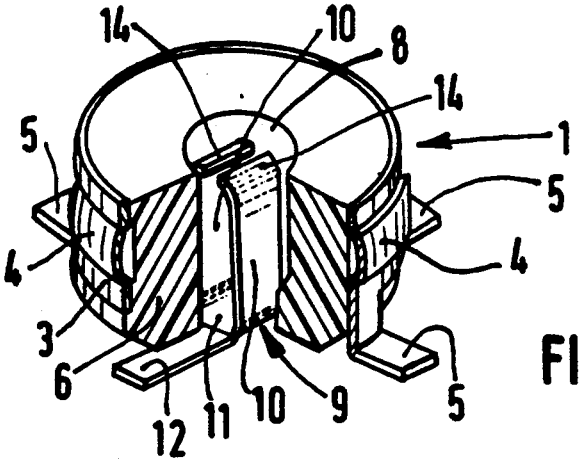
FIG. 3 is a perspective sectional view of the connector element arranged as a socket of the connector of FIGS. 1 and 2.
Figure 4:
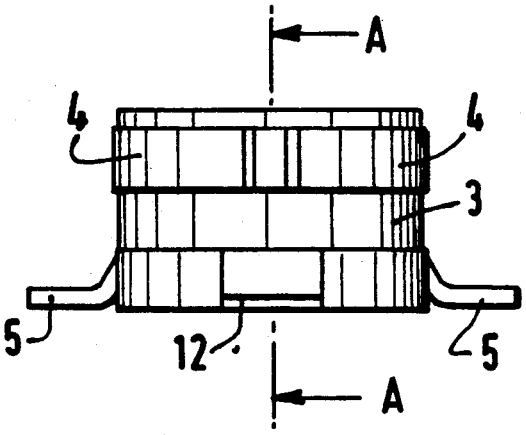
FIG. 4 is a view, in elevation, of the connector element of FIG. 3.
Figure 5:
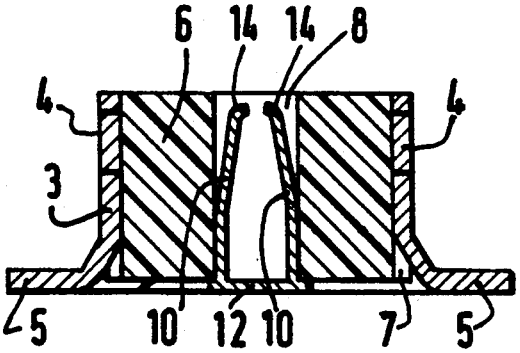
FIG. 5 is a sectional view, along A—A of FIG. 4.

A female central contact 9 which, as may be seen better in FIG. 3, consists of a part of substantially U-shaped cross section comprising two elastic branches 10 connected at their rear portion by a web 11 which is continued by a lug 12 extending radially outwards, is mounted inside the central hole 8 of the insulation 6.

Figure 6:
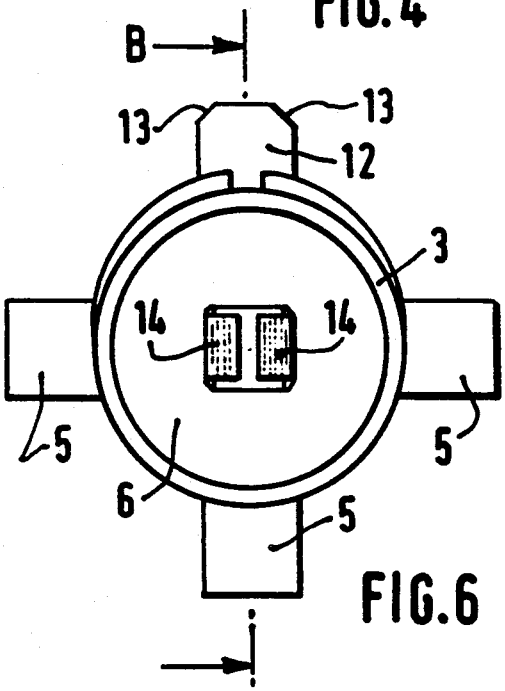
FIG. 6 is a plan view of the connector element of FIG. 4.
Figure 7:
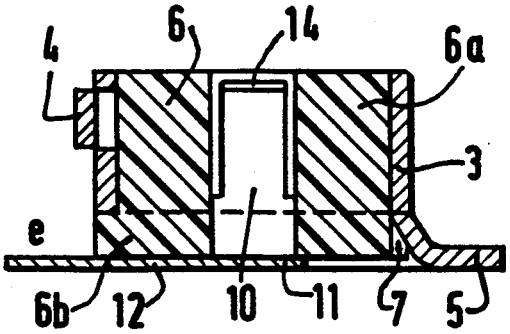
FIG. 7 is a sectional view along B—B of FIG. 6.
Figure 8:
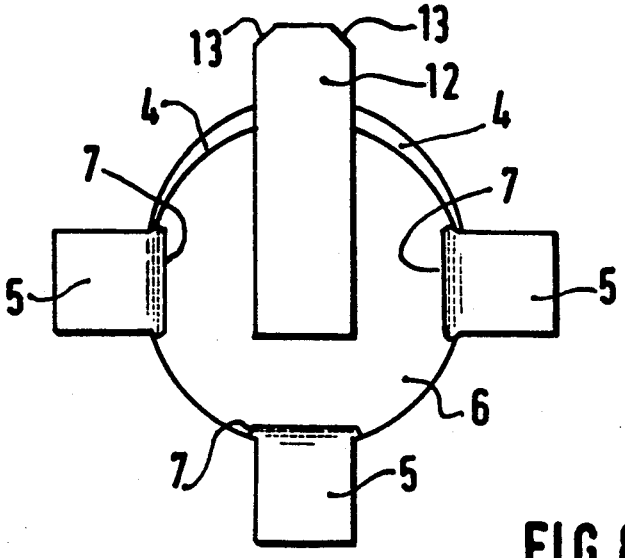
FIG. 8 is a view, from below, of this connector element

As may be seen in FIGS. 6 and 8, the end of the lug 12 has two end chamfers 13 constituting polarization means in order to distinguish it from the lug 5 with a view to positioning the socket on the board.

The elastic branches 10, in their rear portion, are tight-fittingly mounted in the hole 8 of the insulation 6 and are inclined one towards the other in the direction of their free front end in order to be able to move apart elastically during the engagement of a corresponding male contact.

The ends 14 of the branches 10 are folded over towards each other so as to constitute an internal flange.

The lugs 5 and 12 are intended to be soldered by their end face onto corresponding pads of a printed electronic-circuit board.

On account of the fact that a certain axial distance (e, FIG. 7), corresponding to the height of the segment 6*b* of the insulation, separates the rear end of the ground-contact bush 3 from the lug 12 continuing the central contact, good electrical isolation is ensured between the ground contact and the central contract.

The complementary connector element arranged as a plug 2 will now be described by referring to FIGS. 1 and 2.

The plug 2 comprises a tubular portion 15 for coupling to the socket and a tubular portion 16 for the connection of a coaxial cable.

In the example illustrated, the plug 2 is elbowed and the connection portion 16 extends at right angles in relation to the coupling portion 15, which permits the coaxial cable to be led in parallel to the printed board.

The coaxial cable conventionally comprises a central conductor 17 separated by an insulation 18 from a braid 19 forming the ground contact and surrounded by an external protective jacket 20.

The connection portion 16 comprises a tubular sleeve 21 into contact with which is brought the stripped end of the ground conductor 19 of the cable in order to be attached therein by soldering or crimping.

The coupling portion 15 comprises a cylindrical bush 22 made integrally with the sleeve 21 and capable of engaging onto the bush 3 of the socket 1.

A tubular insulation 23, provided on its periphery with a groove 24 for retaining it on an internal flange 25 produced in the wall of the socket 22, is engaged inside the bush 22.

A central contact 26 is housed in the bush 22 by being immobilized in the insulation 23. This contact is cylindrical and comprises, at its rear end, a slot 27 into which the stripped end of the central conductor 17 of the cable engages and is immobilized therein by soldering or crimping.

The contact 26 comprises a harpoon-shaped portion 28 for immobilizing it in the insulation 23.

The contact 26 furthermore comprises a tapered head portion 29 capable of being introduced between the branches 10 of the female contact by moving the latter apart.

The head portion 29 comprises a frustoconical end continued by a cylindrical portion which is itself connected by a short transition portion to a portion 30 of small diameter 30 which produces a groove between the end portion 29 and that portion of the contact 26 which is retained in the insulation 23.

The rear end of the bush 22 is closed off by a cover 31 after attachment of the plug onto the cable.

Figure 9:
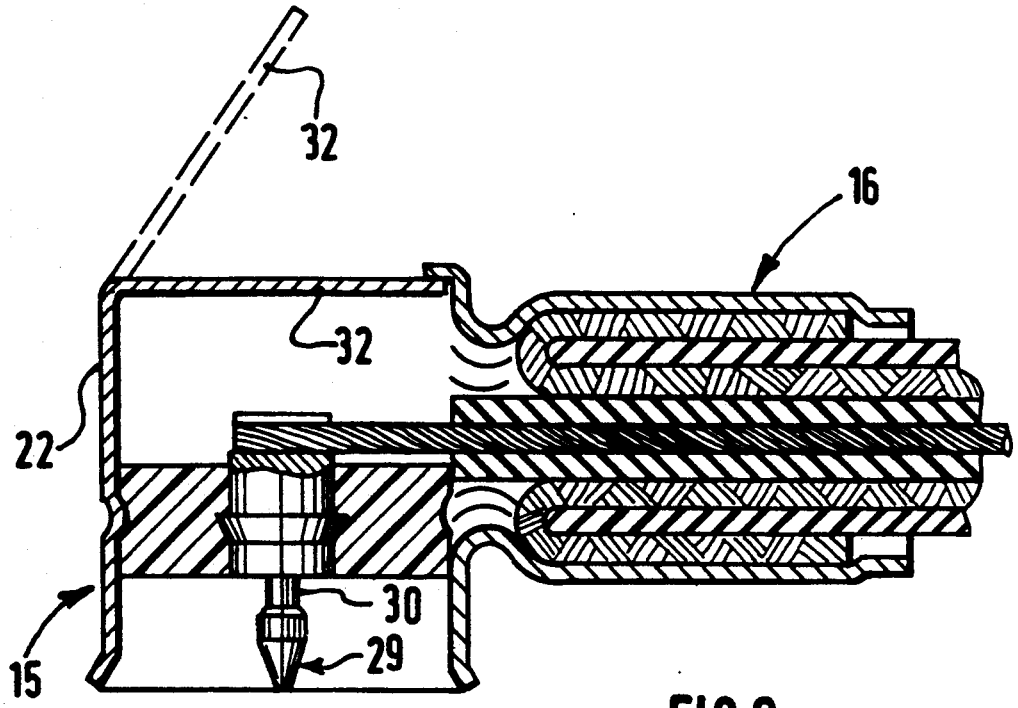
FIG. 9 is a sectional view of an alternative form of the other connector element, arranged as a plug, of the connector illustrated in FIGS. 1 and 2.

In the alternative embodiment illustrated in FIG. 9, the closing off of the upper end of the bush 22 is performed by folding over a wall element 32 produced integrally with the bush 22.

While the connecting up of the two connector elements 1 and 2 is being carried out, the head portion 29 of the central contact 26 of the plug 2 is inserted between the branches 10 of the central contact 9 of the socket 1 and elastically moves apart these branches which, after passage of the head, elastically return so that their curved-over ends 14 engage by snap-fastening in the groove 30 of the contact 26.

Thus, locking by snap-fastening is produced in the region of the central contacts of the connector elements. A contact is simultaneously produced between the external bushes, respectively 22 of the plug 2, and 3 of the socket 1, by bearing of the bush 22 on the elastic tabs 4 of the bush 3.

The design of the connector elements according to the invention enables the two connector elements to be separated without exerting significant forces on the socket which could cause a loosening of the latter from the board, thus rendering unnecessary any mechanical means for attaching the socket to the board. The extraction force may be minimized by a suitable shaping of the folded-over ends 14 of the branches 10 of the central contact of the socket and of the transition portion on the male contact 26 between the end portion 29 and the portion of small diameter forming the retention groove 30.

Although the invention has been described in connection with a particular embodiment, it is quite clear that it is not at all limited thereby and that various alternative forms and modifications may be made to it without thereby departing either from its scope and or from its spirit.

In particular, the connector element arranged as a socket may be fitted with other means, such as pointed elements for attaching it to the printed electronic-circuit board.

I claim:

1. A coaxial connector for connecting a coaxial cable to a printed electronic-circuit board, comprising two connector elements each comprising a central contact, respectively a male and female contact, an external ground contact and an insulation between the central contact and the ground contact, said connector elements comprising means for connecting them electrically and attaching them, respectively, to the end of a coaxial cable and to a printed board, wherein the connector element intended to be attached to the printed board is arranged as a cylindrical socket (1) comprising an external bush (3) which forms a ground contact, is radially elastic over a portion at least of its height and is provided integrally at its rear portion with means (5) for attaching it to a printed board, and a central contact (9) disposed in a central hole (8) of a tubular insulation (6) which is retained in said external bush (3) and is provided, also integrally, at its rear portion, with means (12) for attaching it to said printed board, and wherein the connector element intended to be attached to the coaxial cable is arranged as a plug (2) comprising a tubular portion (16), for connection to the end of a coaxial cable, and a tubular coupling portion (15) comprising a cylindrical external bush forming a ground contact (22), capable of engaging around the external bush of the connector element arranged as a socket, and a central contact (26) which comprises at its rear portion connection means (27) for the central conductor (17) of the coaxial cable and which is immobilized in a tubular insulation (23) retained in said external bush (22), said central contacts of the two connector elements comprising interacting means (14, 30) for locking by snap-fastening.

2. The coaxial connector as claimed in claim 1, wherein the connector element arranged as a plug (2) is elbow shaped and its tubular portion (16) for connecting to the end of the coaxial cable is disposed at right angles in relation to the tubular coupling portion (15) and is preferably produced integrally with it.

3. The coaxial connector as claimed in claim 2, wherein the rear end of the external bush (22) of the coupling portion (15) is fitted with a closing-off element (31, 32) installed after carrying out the connection to the coaxial cable.

4. The coaxial connector as claimed in claim 3, wherein the closing-off element is a separate cover (31).

5. The coaxial connector as claimed in claim 3, wherein the closing-off element is a folded-down portion (32) of the wall of the external bush (22).

6. The coaxial connector as claimed in claim 1, wherein the connector element arranged as a cylindrical socket (1) comprises an elastic female central contact (9), and the other connector element arranged as a plug (2) comprises a pin-shaped male contact (26), the interacting means for locking said central contacts being constituted by an internal flange (14) of the female contact capable of engaging elastically in a retention groove (30), provided on the periphery of the male contact, during the axial engagement of the male contact in the female contact.

7. The coaxial connector as claimed in claim 6, wherein the female contact (9) is produced in the form of a part, of substantially U-shaped cross section, retained by its rear portion in the central hole (8) of the tubular insulation (6) in which said part is mounted, and whose two elastic branches (10) are slightly inclined one towards the other in the direction of their free end and each comprise an end portion (14) folded over inwards in the direction of the other branch.

8. The coaxial connector as claimed in claim 6, wherein the external bush (3) forming a ground contact of the connector element arranged as a socket (1) comprises over a portion of its height at least one cut-out elastic tab (4) projecting radially outwards from said bush (3).

9. The coaxial connector as claimed in claim 6, wherein the external bush forming a ground contact (3) of the connector element arranged as a socket (1) comprises for its attachment and its connection to the printed board a plurality of lugs (5) folded over outwards in relation to the external bush in the same plane at 90° in relation to the axis of said bush.

10. The coaxial connector as claimed in claim 6, wherein the female connect (9) comprises, at its rear portion, a lug (12) made integrally with the web (11) connecting the two elastic branches (10), said lug being folded over at 90° outwards in relation to the axis of the connector element in which said female contact is mounted.

11. The coaxial connector as claimed in claim 10, wherein the lugs (5) produced integrally with the external bush forming a ground contact (3) of the connector element arranged as a socket (1) are different from the lug (12) extending the central elastic contact (9).

12. The coaxial connector as claimed in claim 11, wherein the lug (12) of the central contact has end chamfers (13).

* * * * *